US008348080B2

(12) United States Patent
Baptiste

(10) Patent No.: US 8,348,080 B2
(45) **Date of Patent: *Jan. 8, 2013**

(54) TRASH CONTAINER WITH RETRACTABLE WEATHERPROOF COVER

(76) Inventor: George H. Baptiste, Baldwin, NY (US)

( * ) Notice: Subject to any disclaimer, the term of this patent is extended or adjusted under 35 U.S.C. 154(b) by 1027 days.

This patent is subject to a terminal disclaimer.

(21) Appl. No.: 11/580,999

(22) Filed: Oct. 16, 2006

(65) Prior Publication Data

US 2008/0110895 A1 May 15, 2008

(51) Int. Cl.
*B65D 43/12* (2006.01)
*B65D 43/20* (2006.01)
*E06B 9/00* (2006.01)

(52) U.S. Cl. ..... 220/345.1; 220/350; 220/908; 160/37

(58) Field of Classification Search ..... 220/345.1, 220/350, 908, 262, 254.1, 254.4, 811–813; 160/37, 36, 235
See application file for complete search history.

(56) References Cited

U.S. PATENT DOCUMENTS

| | | | | |
|---|---|---|---|---|
| 2,739,730 | A | 3/1956 | Jonas | |
| 4,406,493 | A * | 9/1983 | Albrecht et al. | 296/100.04 |
| 4,432,591 | A * | 2/1984 | Rinkewich | 312/297 |
| 4,601,953 | A | 7/1986 | Haffer | |
| D306,501 | S * | 3/1990 | Scarrone | D25/49 |
| 5,107,990 | A * | 4/1992 | Wicherski et al. | 206/366 |
| 5,184,864 | A * | 2/1993 | Teigen et al. | 296/186.4 |
| 5,400,914 | A * | 3/1995 | Lin | 220/345.4 |
| 5,415,315 | A * | 5/1995 | Ramirez | 220/345.2 |
| 5,730,451 | A * | 3/1998 | Walker | 280/47.26 |
| 5,761,750 | A * | 6/1998 | Mazzola et al. | 4/500 |
| 5,996,831 | A * | 12/1999 | Teok | 220/230 |
| 7,108,148 | B2 * | 9/2006 | Lu | 220/263 |
| 7,114,629 | B2 * | 10/2006 | Panek, Jr. | 220/345.1 |
| 2009/0184124 | A1 * | 7/2009 | Tubman | 220/495.06 |

FOREIGN PATENT DOCUMENTS

GB 2414376 11/2005

* cited by examiner

*Primary Examiner* — Robin Hylton
(74) *Attorney, Agent, or Firm* — Maier & Maier PLLC

(57) ABSTRACT

Apparatus for enclosing and containing its contents. Apparatus may include a container having wheels and a handle. Apparatus may include a top portion with a retractable cover capable of protecting the contents of the container from weather and other harmful elements.

8 Claims, 9 Drawing Sheets

110
102
100
107
112
203
106

203
110
106
102

100
112

110
102
203
100
106
112

110
109
108
111
102
110
203
102
100
112

102
100
112
110
203
106

TRASH CONTAINER WITH RETRACTABLE WEATHERPROOF COVER

FIELD OF THE INVENTION

The present invention generally relates to containers. Particularly, the present invention relates to those containers having a cover capable of protecting articles contained therein from factors such as weather, animals, and spills.

BACKGROUND

Present containers have basic means for covering articles contained therein. Such coverings offer little protection from natural elements and may lead to loss of contents from wind, mishandling, animals or other factors. Some present containers have coverings that are separable from the container and are therefore susceptible to separation and loss or theft. Other containers have coverings that are attached, but provide minimal protection from the elements.

Current containers comprise a cover having a roll-top design, a concentrically arranged sliding design, and a hinge design. Such designs offer a small degree of protection from weather and offer a degree of strength that can withstand only minor stress. As such the contents of present containers are prone to weather related damage as well as inadvertent spills and theft.

SUMMARY OF THE INVENTION

In accordance with at least one exemplary embodiment of the invention, a container with a protective cover that may optionally be used for refuse includes a container having a movable top capable of enclosing contents therein, thereby providing protection from weather, animals, and spills.

A further exemplary embodiment may provide a handle for sliding the cover, and a mechanism for locking the cover in the closed position. This can act to decrease the risk of theft or handling of the contents by third parties. This can also prevent weather related damage to the contents of the container or spilling of the container's contents by wind or animals. Yet a further exemplary embodiment may provide for a hingeless design providing for increased strength. Further, a series of flanges may act like shutters when the cover is closed, thereby protecting contents of the container from weather.

BRIEF DESCRIPTION OF THE DRAWINGS

Further advantages of embodiments of the present invention will be apparent from the following detailed description of the preferred embodiments thereof, which description should be considered in conjunction with the accompanying drawings in which.

DETAILED DESCRIPTION

Figure 1:
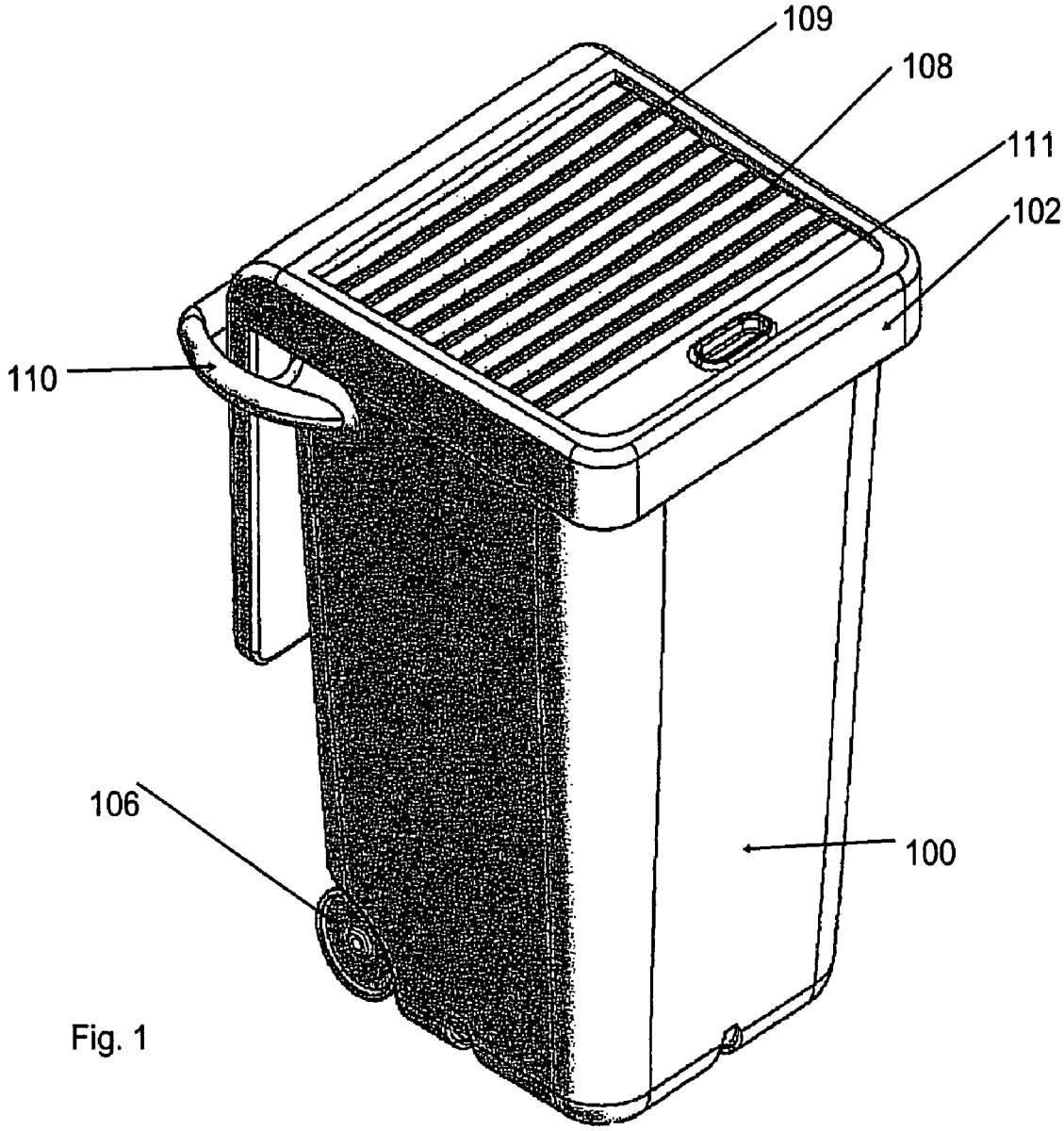
FIG. 1 shows an exemplary perspective view of a container having a retractable cover in the closed position.
Figures 2, 3, 4, 5, 6, 7:
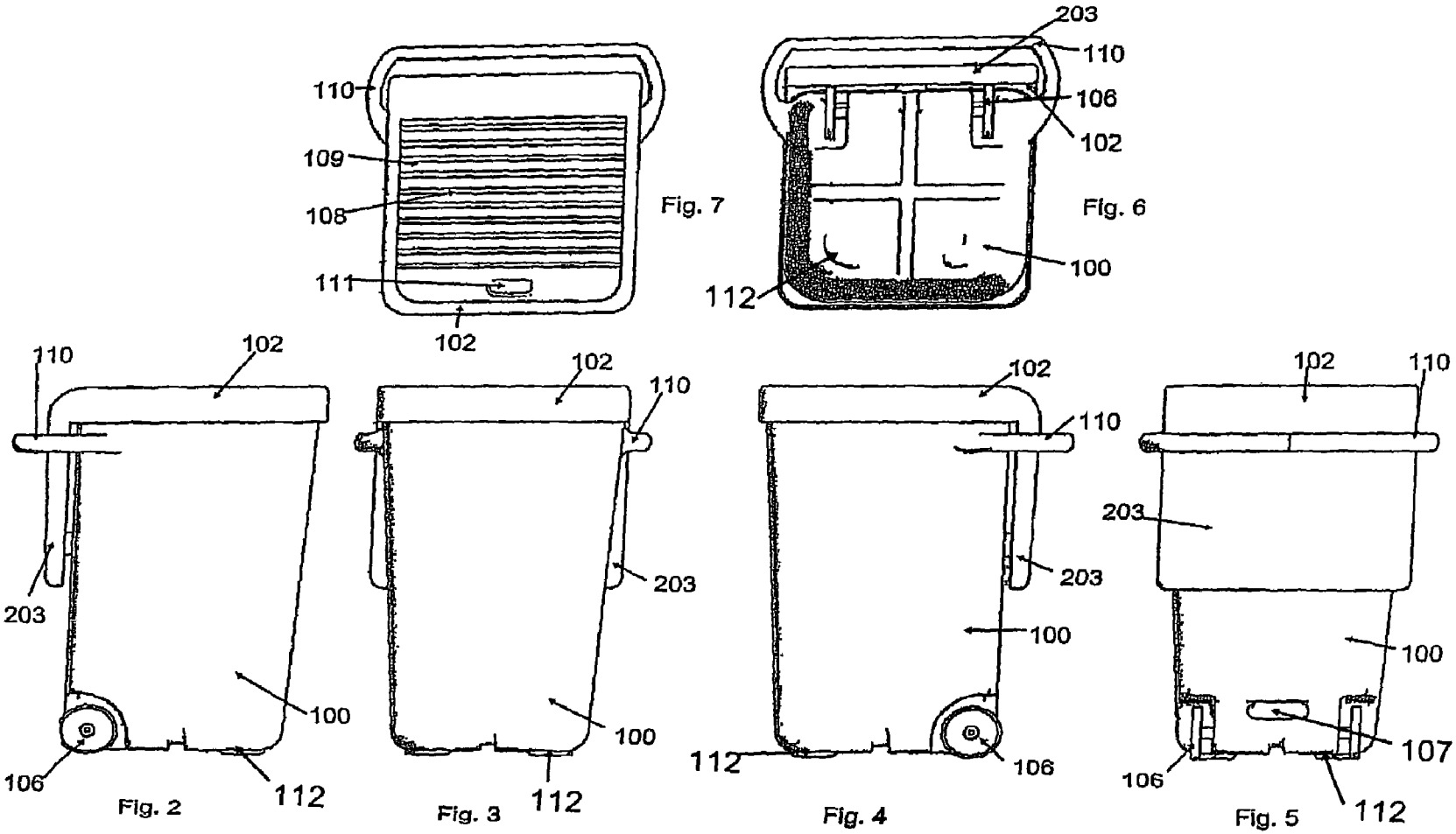
FIG. 2 shows an exemplary side view of the container of FIG. 1.
FIG. 3 shows an exemplary front view of the container of FIG. 1.
FIG. 4 shows an exemplary opposite side view of the container of FIG. 1.
FIG. 5 shows an exemplary rear view of the container of FIG. 1.
FIG. 6 shows and exemplary bottom view of the container of FIG. 1.
FIG. 7 shows an exemplary top view of the container of FIG. 1 with a cover in the closed position.

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description, discussion of several terms used herein follows.

The word "exemplary" is used herein to mean "serving as an example, instance, or illustration." Any embodiment described herein as "exemplary" is not necessarily to be construed as preferred or advantageous over other embodiments. Likewise, the term "embodiments of the invention" does not require that all embodiments of the invention include the discussed feature, advantage or mode of operation.

Referring generally to FIGS. 1-14, a trash container with a retractable cover is shown. An exemplary embodiment may include a container 100, a top portion 102, a wheelset 106 for transport, a cover 108, cover members 109, a handle 110 for moving the container, and a handle 111 for opening and closing cover 108. In one exemplary embodiment, the lower portion of container 100 may be about 6 to 26 inches wide, but more preferably 16 inches wide. Top portion 102 may be about 10 to 30 inches wide, but preferably 19 inches wide. The top portion of container 100 may be about 10 to 30 inches wide, but preferably 19 inches wide. Container 100 and attached top portion 102 may be about 20 to 40 inches tall, but preferably 35 inches tall.

FIG. 1 shows an exemplary embodiment of a trash container with retractable cover. One exemplary embodiment may include container 100 with wheelset 106 situated on the bottom portion of container 100 to allow transport. A handle 107 may be positioned on the lower portion of container 100 to accommodate lifting. Top portion 102 may be formed to accommodate slidably mounted cover 108 comprised of cover members 109. Handle 110 may be formed on the rear of container 100 to allow for transportation of the trash container. Handle 111 may be formed on cover 108 to accommodate positioning of cover 108.

FIGS. 2-7 show an exemplary embodiment of a trash container. The trash container may include container 100 having wheelset 106 arranged to provide a transport means. The bottom of container 100 may include a support structure 112 formed distally to wheelset 106 to increase stability of container 100. Top portion 102 may include cover 108, which may comprise cover members 109. Handle 111 may be used to reposition cover 108 to allow for insertion, removal, or covering of the contents of container 100. Handle 110 may be used to reposition the container.

Figure 8:
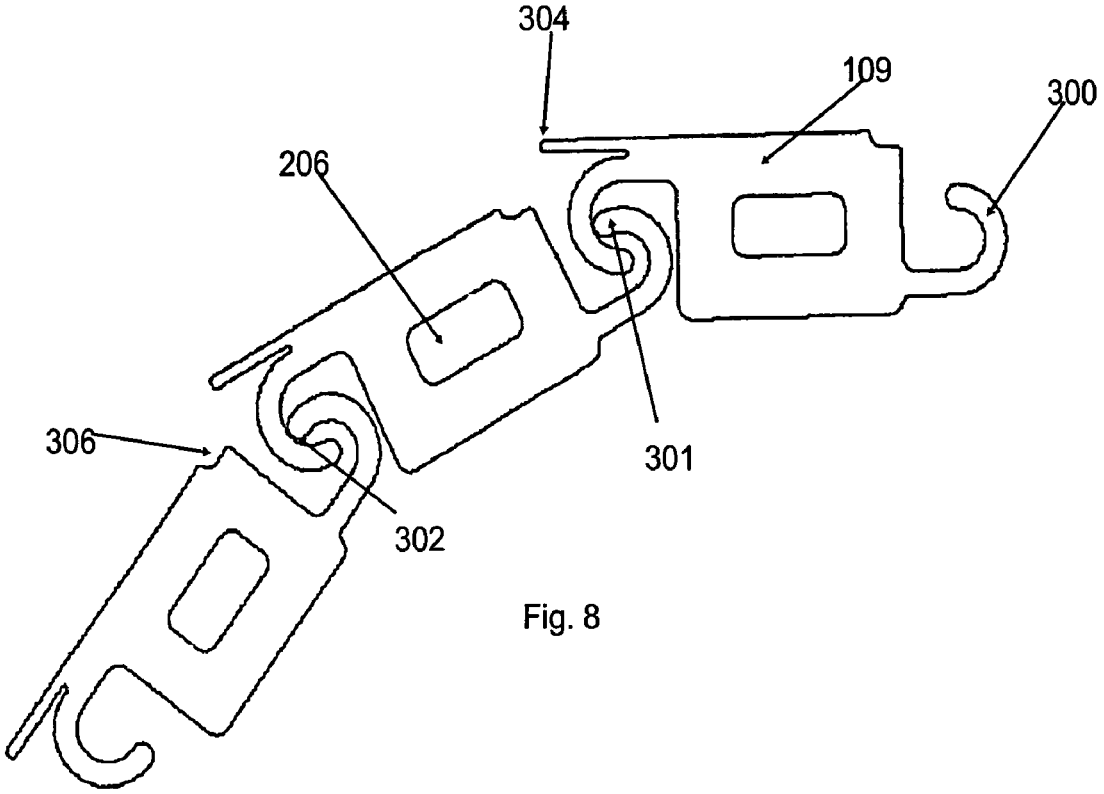
FIG. 8 shows an exemplary diagrammatical side view of a retractable cover.

FIG. 8 shows an exemplary embodiment of cover 108 and cover members 109. Cover members 109 may include flanges 206. One embodiment of cover members 109 may include a hook-shaped member 300 formed on opposing and parallel sides of individual member 109. Hook-shaped member 300 may be formed to include a distal portion 301 arranged to contact a concave portion of hook-shaped member 300 of an adjacent cover member 109 so as to form a linkage 302 thereby accommodating interlinking of consecutive members 109. Yet another embodiment of cover member 109 may include an overhang 304. Cover members 109 may be formed to include an overhang groove 306 capable of accepting and appropriately positioned to accept overhang 304. Cover 108 may be arranged so that when in the closed position, overhang 304 is accepted by overhang groove 306, and cover 108 creates a substantially sealed container thereby protecting contents of the container from weather and outside elements.

Figure 9:
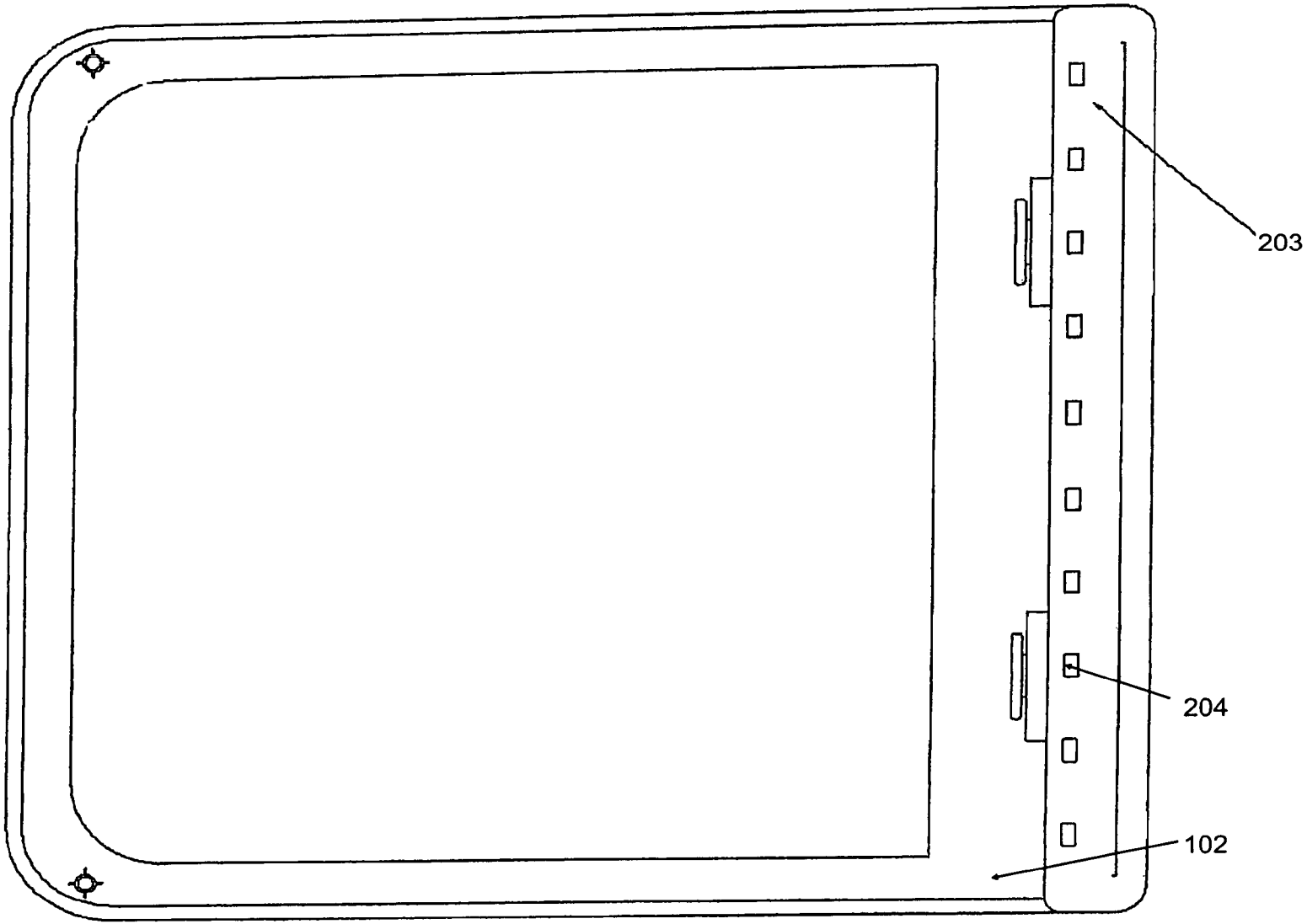
FIG. 9 shows an exemplary bottom view top portion of the container of FIG. 1.

FIG. 9 shows a bottom view of an exemplary embodiment of top portion 102. A vertical portion 203 of top portion 102 may be formed to include drainage holes 204. In one exemplary embodiment, drainage holes 204 may be formed in both vertical portion 203 and the horizontal portion of top portion 102.

Figure 12:
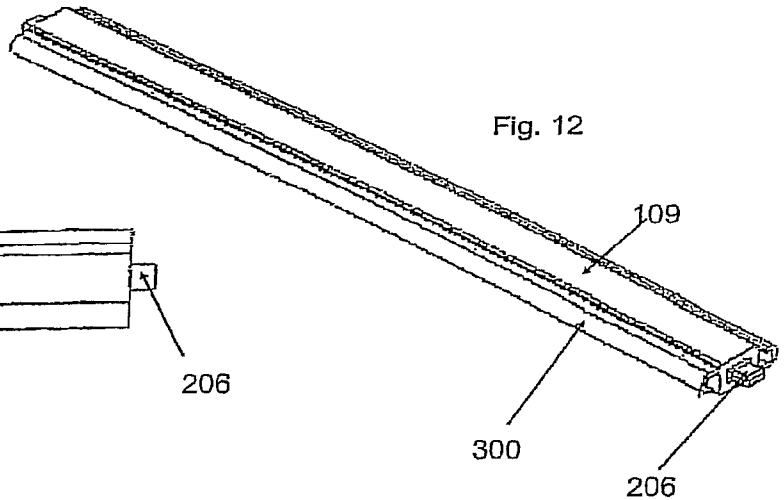
FIG. 12 shows an exemplary perspective view of a cover member.
Figure 10:
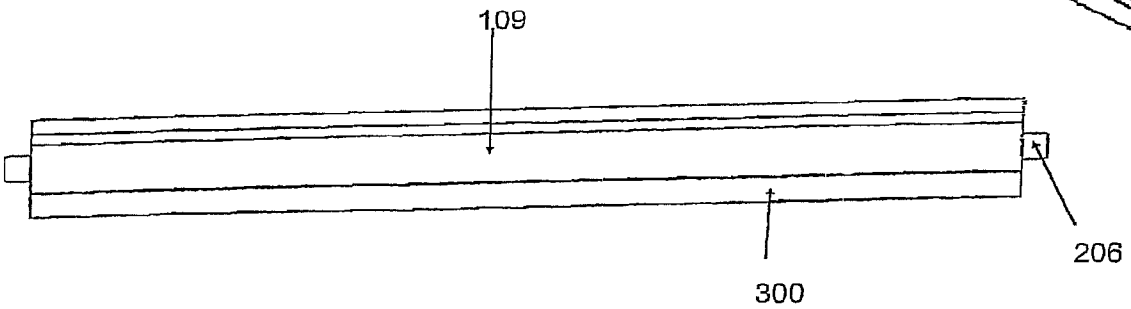
FIG. 10 shows an exemplary top view of a cover member.
Figure 11A:
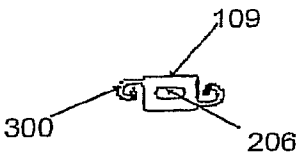
FIG. 11*a* shows an exemplary front view of a cover member.
Figure 11B:
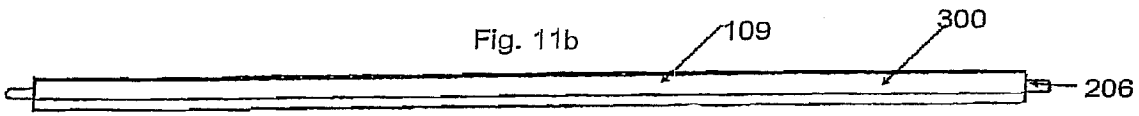
FIG. 11*b* shows an exemplary side view of a cover member.

FIGS. 10-12 show an exemplary embodiment of cover member 109. Cover member 109 may include a first hook member 300 positioned on a first end of member 109 parallel to an inverted second hook member 300 formed on an opposing second end of member 109. This allows interlocking with hook member 300 of an adjacent cover member 109. Cover member 109 may also include a flange 206.

Figure 13:
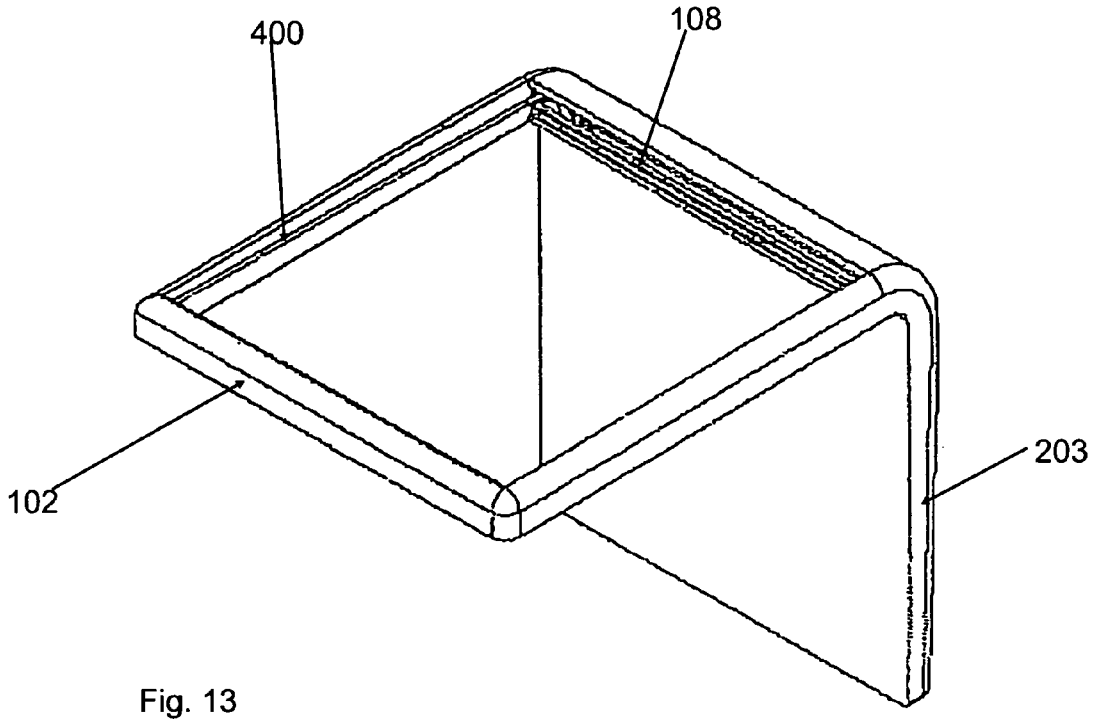
FIG. 13 shows an exemplary perspective view of the top portion of the container of FIG. 1.

FIG. 13 shows an exemplary embodiment of top portion 102. Top portion 102 may include inwardly facing grooves 400 wherein cover 108 may be slidably mounted. Grooves 400 may be formed to accommodate flanges 206. One embodiment of top portion 102 may include vertical portion 203 formed from top portion 102 wherein cover 108 may be position when retracted. A further exemplary embodiment may include flanges attached to grooves 400 that act upon cover 108 when closed so as to require applied pressure to reposition cover 108 to a substantially open position.

Figure 14:
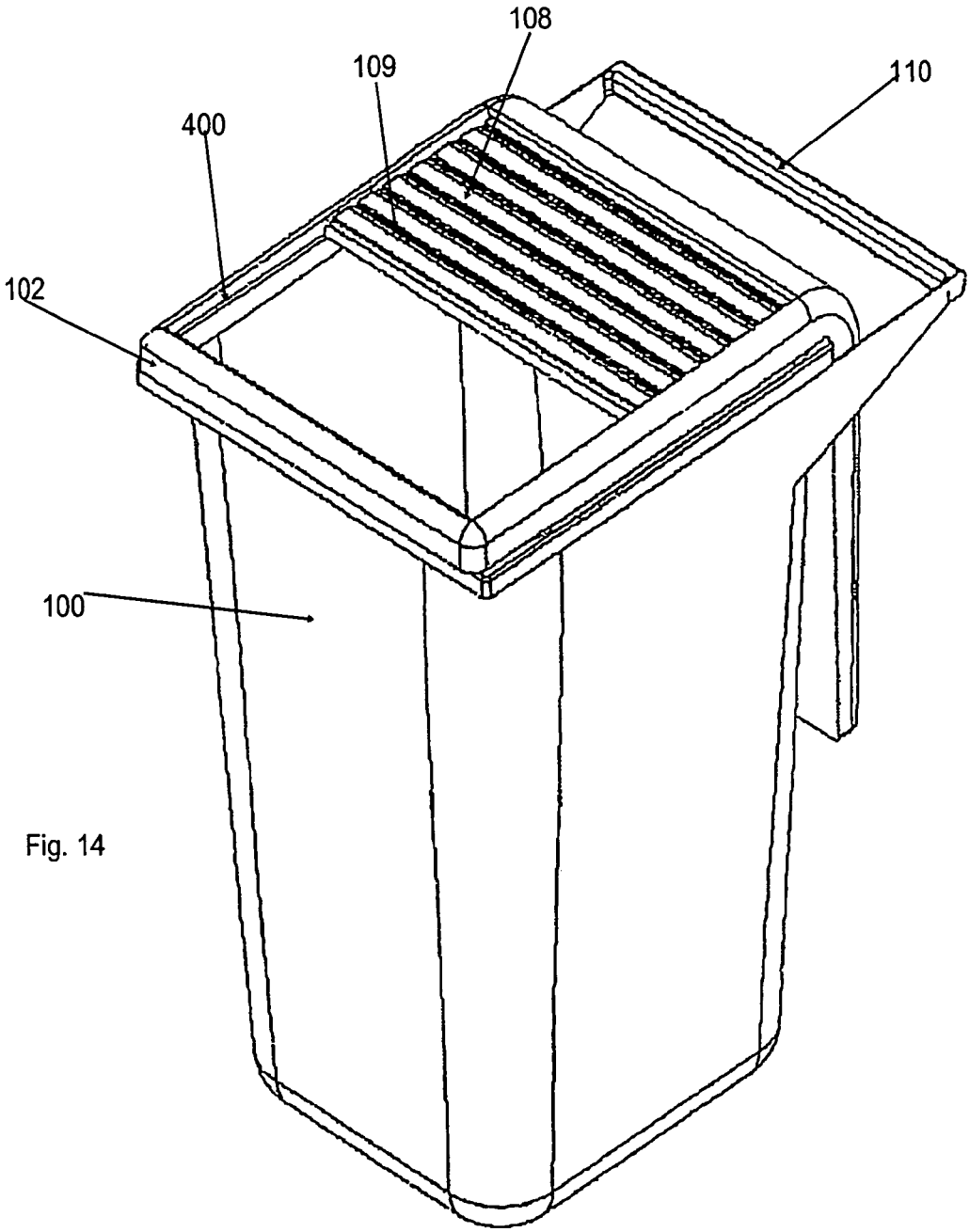
FIG. 14 shows an exemplary perspective view of a container with retractable cover in a substantially open position.

FIG. 14 shows one exemplary embodiment of a trash container with retractable cover, which may include container 100 having top portion 102, which forms an opening for container 100. Container 100 may include a handle joined to the rear of container 100 for transport or relocation. Top portion 102 may include inwardly facing parallel grooves 400 wherein cover 108 may be slidably mounted. Flanges mounted within grooves 400 may be constructed to act upon cover 108 thereby fastening cover 108 in the closed position.

Figure 15:
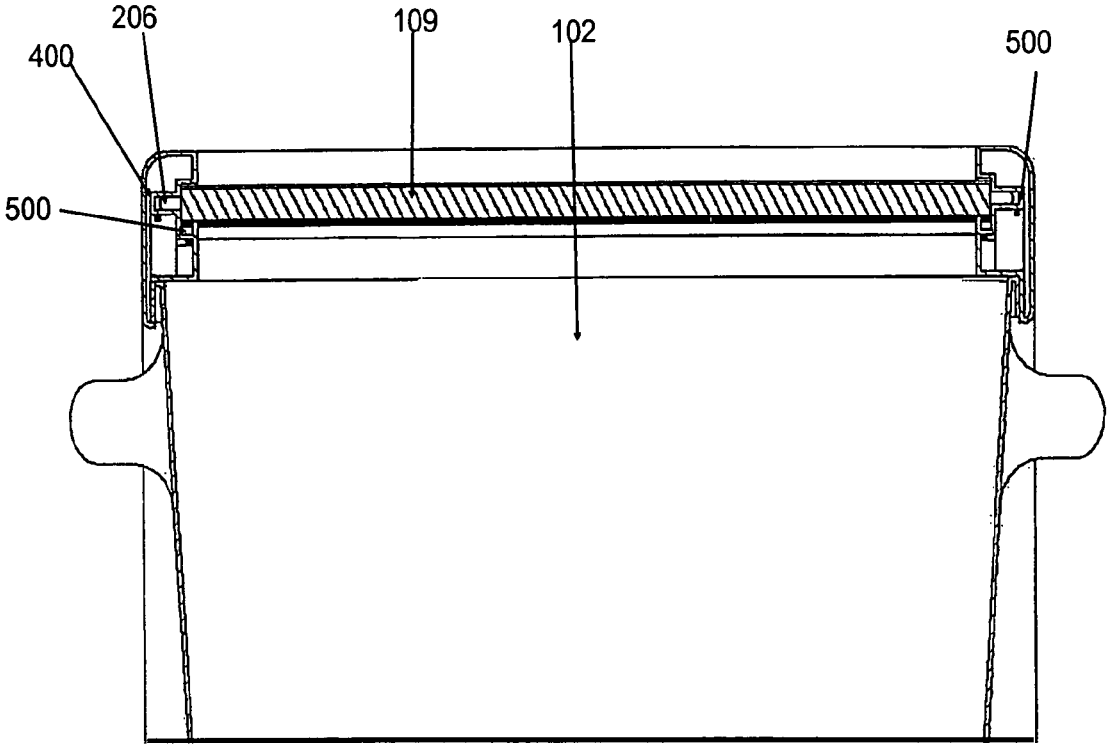
FIG. 15 shows an exemplary cross-sectional view of the top portion of the container of FIG. 1.

FIG. 15 shows an exemplary embodiment of top portion 102. Flanges 206 of cover members 109 may be positioned in grooves 400 so as to allow water to flow into a drainage canal 500. In one exemplary embodiment, drainage canal 500 may be constructed to guide water to efflux from drainage holes 204.

Figure 17:
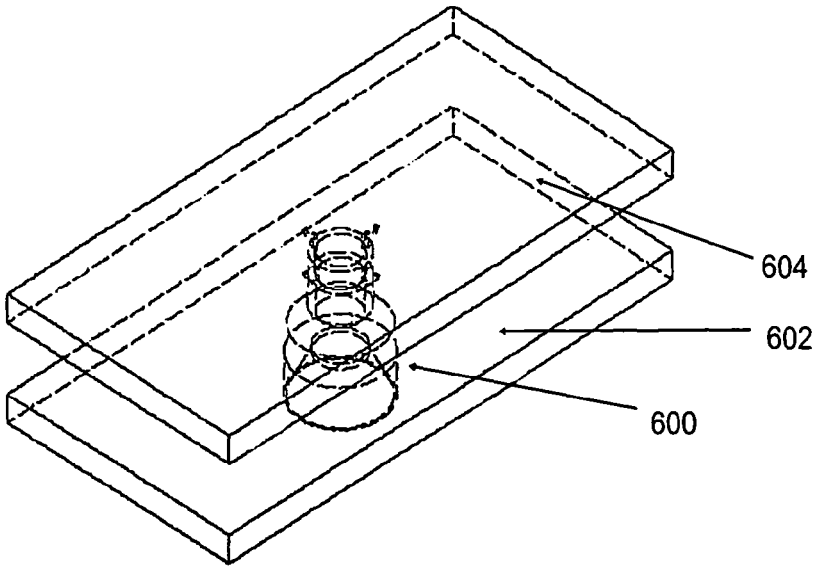
FIG. 17 shows an exemplary perspective view of the attachment mechanism of FIG. 16.
Figure 16:
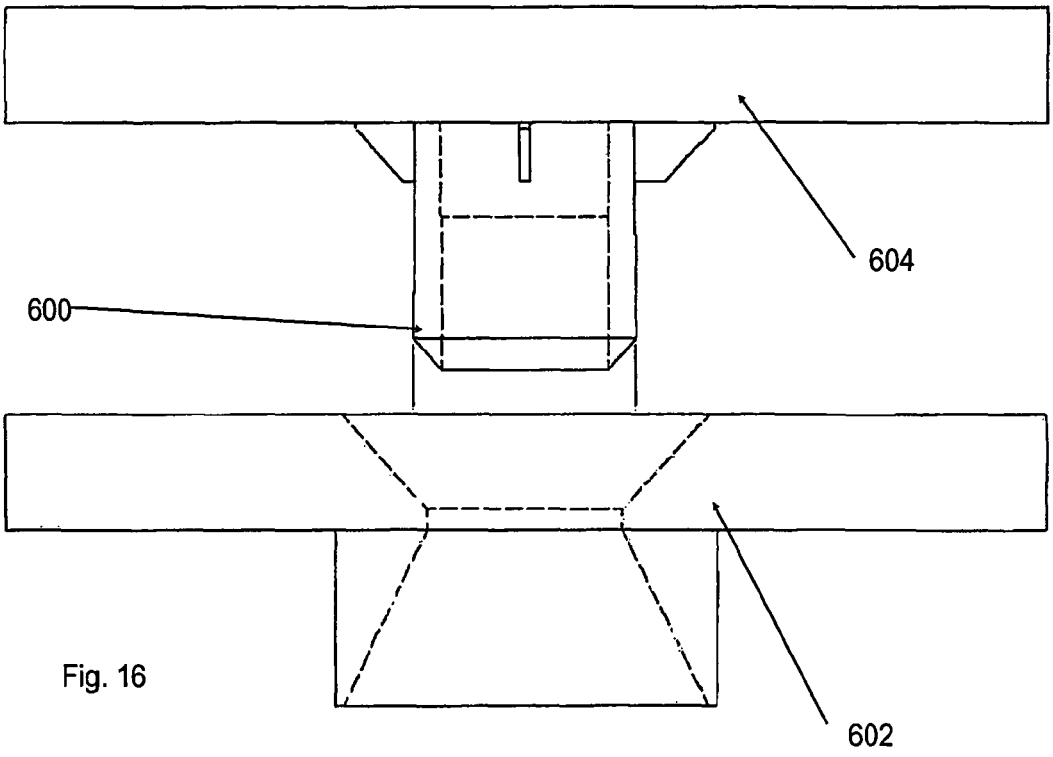
FIG. 16 shows an exemplary diagrammatical view of an attachment mechanism.

FIGS. 16-17 show an exemplary embodiment of a fastener assembly 600. One or more fasteners 600 may be situated to interface with top portion 102 and container 100 thereby fastening top portion 102 to container 100. In one exemplary embodiment, a female fastener 602 attached to container 100 may be arranged to accommodate receipt of a male fastener 604 attached to top portion 102 thereby fastening top portion 102 to container 100. This arrangement can accommodate shipment of the container in separate components for subsequent assembly.

The foregoing description and accompanying drawings illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A containment apparatus comprising:

a bottom wall;

a rear wall extending vertically from said bottom wall;

a pair of side walls extending from opposite edges of said bottom wall, the vertical edges of said side walls meeting the vertical edges of said rear wall; and a front wall extending vertically from said bottom wall, the vertical edges of said front wall meeting the vertical edges of said side walls, said front, rear, and side walls having substantially equal height;

a top portion coupled to said rear wall, front wall and side walls, said top portion comprises an aperture defined therein; and a slidably retractable cover coupled to said top portion and positioned within said aperture;

wherein said top portion comprises a horizontal portion and a vertical portion coupled thereto, wherein said slidably retractable cover is coupled to said horizontal portion and said vertical portion;

wherein at least a portion of said slidably retractable cover is positioned within said vertical portion; and wherein said slidably retractable cover comprises a plurality of horizontal members formed to include hook-shaped portions on opposite and parallel sides of said members, said hook-shaped portions capable of engaging one another thereby movably attaching said horizontal members.

2. The containment apparatus of claim 1, wherein said slidably retractable cover comprises a locking mechanism that facilitates locking said slidably retractable cover in a closed position.

3. A containment apparatus comprising:

a bottom wall;

a rear wall extending vertically from said bottom wall;

a pair of side walls extending from opposite edges of said bottom wall, the vertical edges of said side walls meeting the vertical edges of said rear wall;

a front wall extending vertically from said bottom wall, the vertical edges of said front wall meeting the vertical edges of said side walls, said front, rear, and side walls having substantially equal height;

a top portion coupled to said rear wall, front wall and side walls, said top portion comprises an aperture defined therein; and a slidably retractable cover coupled to said top portion and positioned within said aperture, said slidably retractable cover prevents against weather damage and is substantially flat, said slidably retractable cover comprising a plurality of horizontal members comprising:

a first hook-shaped portion attached to a first side of said horizontal member;

a second hook-shaped portion inversely attached to a second and opposite side of said horizontal member; and a distal portion of said first hook-shaped portion capable of movably engaging with a concave portion of said second hook-shaped portion of an adjacent horizontal member.

4. The containment apparatus of claim 3, wherein said slidably retractable cover comprises a locking mechanism that facilitates locking said slidably retractable cover in a closed position.

5. The containment apparatus of claim 3, wherein said horizontal members comprise a flange extending from a top surface of said horizontal member; an opposite end of said top surface of said horizontal member formed to include a recess capable of receiving said flange of an adjacent horizontal member.

6. The containment apparatus of claim 1, wherein said horizontal members comprise:

a top surface that has a first end and an opposite second end;

a flange extending from said first end; and a recess defined on said top surface substantially near said second end, said recess capable of receiving a flange of an adjacent horizontal member.

7. The containment apparatus of claim 3, wherein said top portion comprises a horizontal portion and a vertical portion coupled thereto, wherein said slidably retractable cover is coupled to said horizontal portion and said vertical portion.

8. The containment apparatus of claim 7, wherein at least a portion of said slidably retractable cover is positioned within said vertical portion.

* * * * *